United States Patent [19]

Rothmayer

[11] 4,125,273

[45] Nov. 14, 1978

[54] SEPARABLE OR FOLDABLE SKI

[76] Inventor: Karl-Heinz Rothmayer, Kastanienallee 10, D-8023 Grosshesselohe bei Munchen, Fed. Rep. of Germany

[21] Appl. No.: 805,631

[22] Filed: Jun. 13, 1977

[30] Foreign Application Priority Data

Nov. 6, 1974 [DE] Fed. Rep. of Germany 2452728

Related U.S. Application Data

[63] Continuation of Ser. No. 629,600, Nov. 6, 1975, abandoned.

[51] Int. Cl.[2] ..... A63C 5/02

[52] U.S. Cl. ..... 280/603; 16/164; 403/100; 403/102

[58] Field of Search ..... 280/603, 602, 607, 601; 403/100, 102; 16/164, 165

[56] References Cited

U.S. PATENT DOCUMENTS

| | | | |
|---|---|---|---|
| 1,875,512 | 9/1932 | Silvestri | 280/603 |
| 2,224,897 | 12/1940 | Burton et al. | 280/603 |
| 2,295,638 | 9/1942 | Doman | 16/164 |
| 2,545,209 | 3/1951 | Meehan | 280/603 |
| 2,791,435 | 5/1957 | Meland | 280/603 |

FOREIGN PATENT DOCUMENTS

| | | | |
|---|---|---|---|
| 34,568 | 6/1912 | Sweden | 280/603 |

*Primary Examiner*—David M. Mitchell
*Attorney, Agent, or Firm*—Marn & Jangarathis

[57] ABSTRACT

The invention relates to a separable or foldable ski. The ski has separate sections pivotally joined together. Located at the joint is a coupling arrangement by means of which the corresponding section may be joined together. In addition, a stabilizing device is provided to join and stiffen the ski in the extended position in order to provide desirable rigidity and resiliency therein.

3 Claims, 16 Drawing Figures

FIG. 2
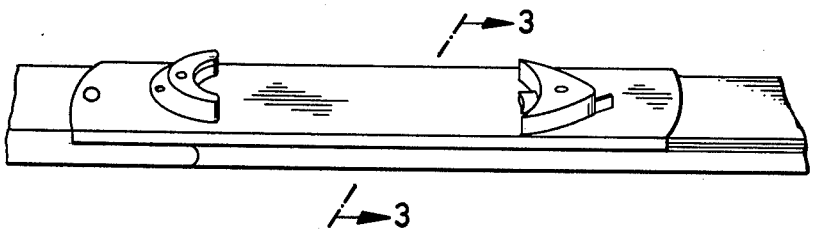
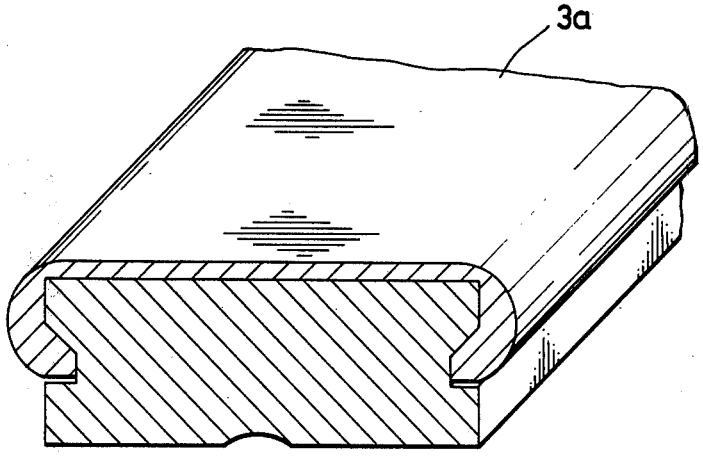
FIG. 3

SEPARABLE OR FOLDABLE SKI

This is a continuation of application Ser. No. 629,600, filed Nov. 6, 1975, and now abandoned.

The invention relates to a separable or foldable ski. Because of their length, known skis are unwiedly and troublesome to transport. It is usually impossible to accommodate them inside a car, and they must therefore be carried on the roof, where they are subjected to corrosive action unless they are equipped with a protective covering.

The invention therefore proposes a separable or foldable ski which may have at least one connecting device or hinge provided along its length between engageable sections. These sections may be folded in relation to each other and may be connected together in the extended position by means of a stabilizing device.

The stabilizing device not only enables the ski to be unfolded to the extended position but also stabilizes the separate sections in the extended position in a manner such that the ski, when ready for use, may have the desirable rigidity and resiliency of a conventional ski.

Other features and advantages of the invention will become apparent from the embodiment given herein solely by way of example with reference to the accompanying drawings wherein:

FIG. 1*a* is a part perspective view of a foldable ski with the stabilizing device out of action;

FIG. 1*b* is a schematic representation of a double hinge in its operative position, with the ski according to FIG. 1*a* in its extended position;

FIG. 2 is a part perspective view of the ski according to FIG. 1*a* in the extended position and with the stabilizing device in its operative position.

FIG. 3 shows a section along the line 3—3 in FIG. 2, in perspective;

Figure 4A:
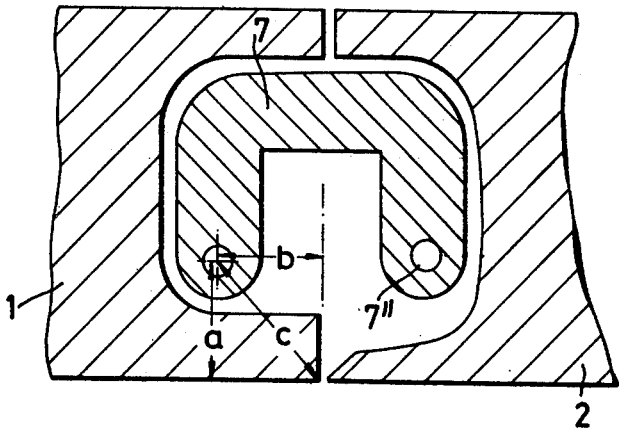
Figure 4B:
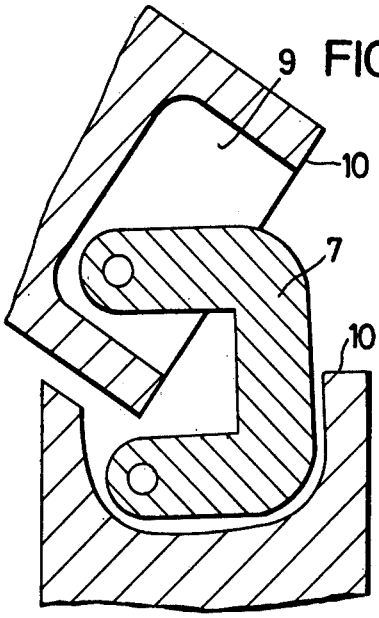
Figure 4C:
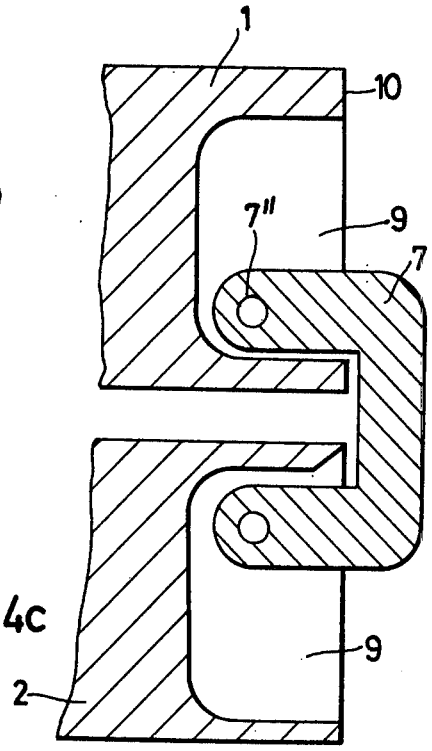
Figure 5:
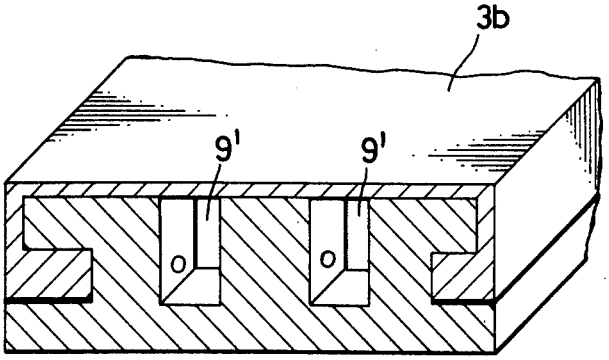
Figure 6:
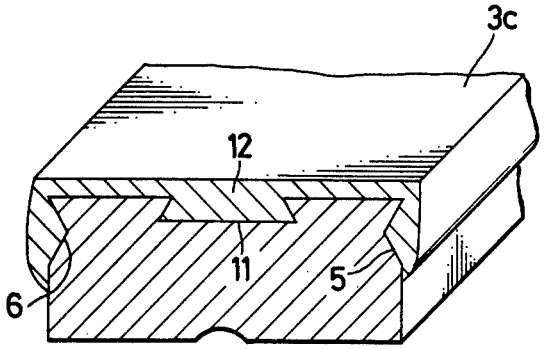
Figure 7:
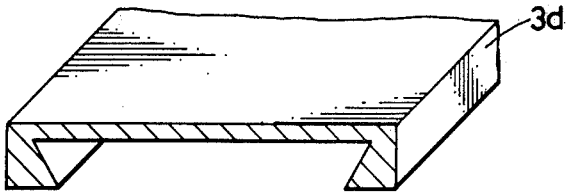
Figure 8:
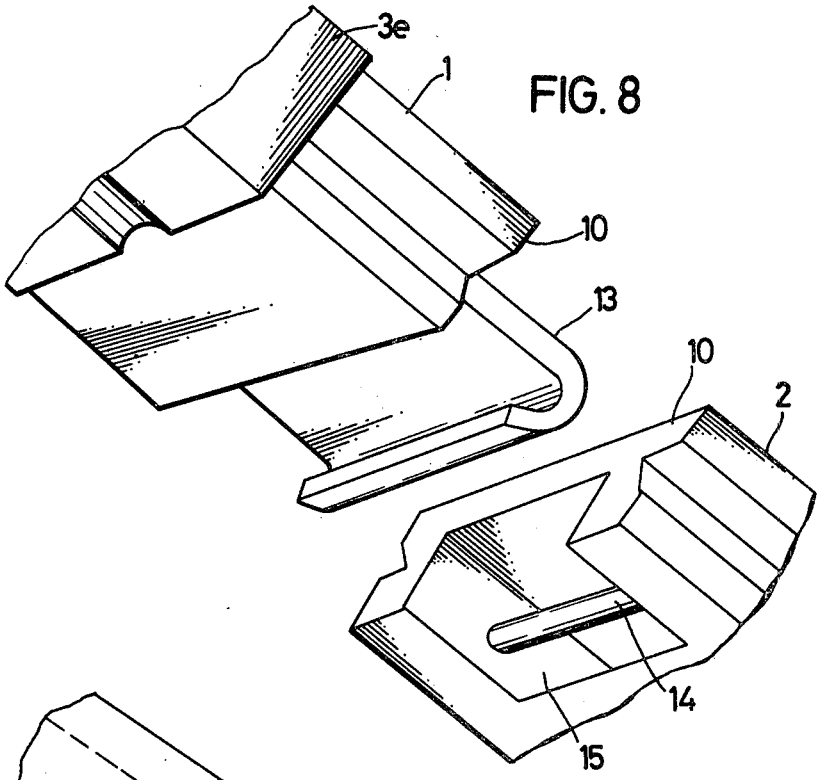
Figure 9:
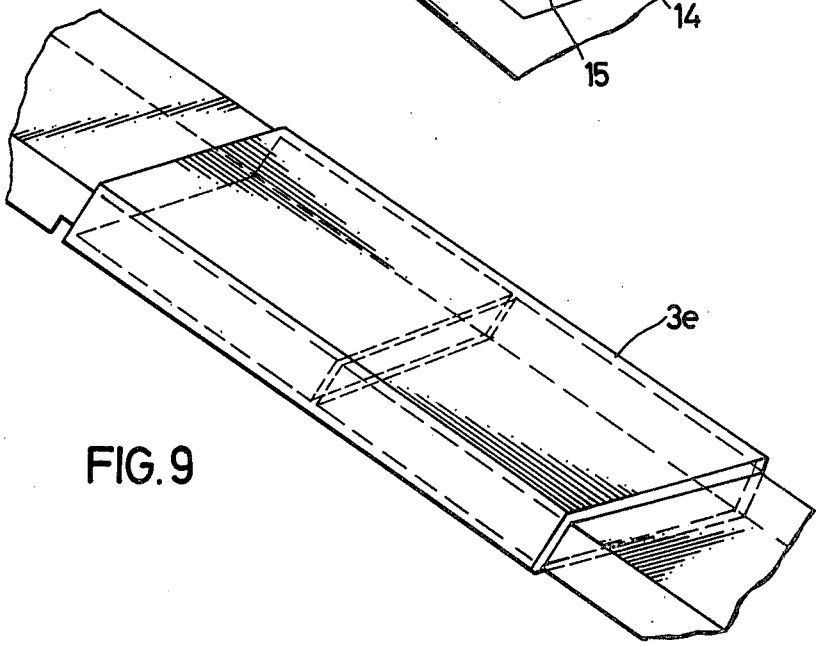
Figure 10:
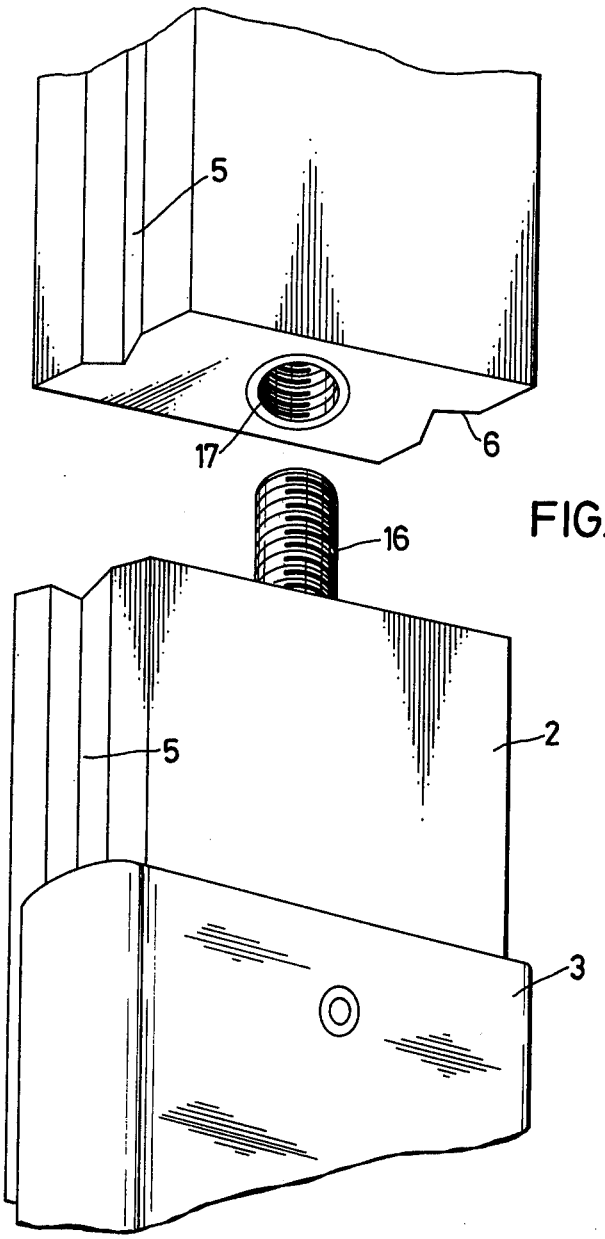
Figure 11:
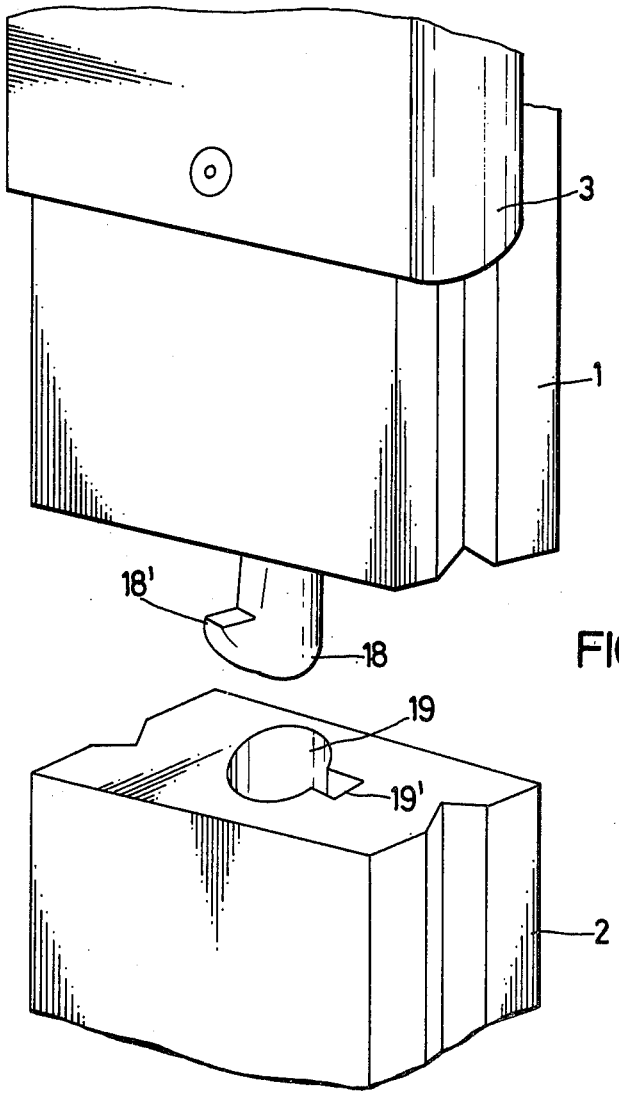
Figure 12:
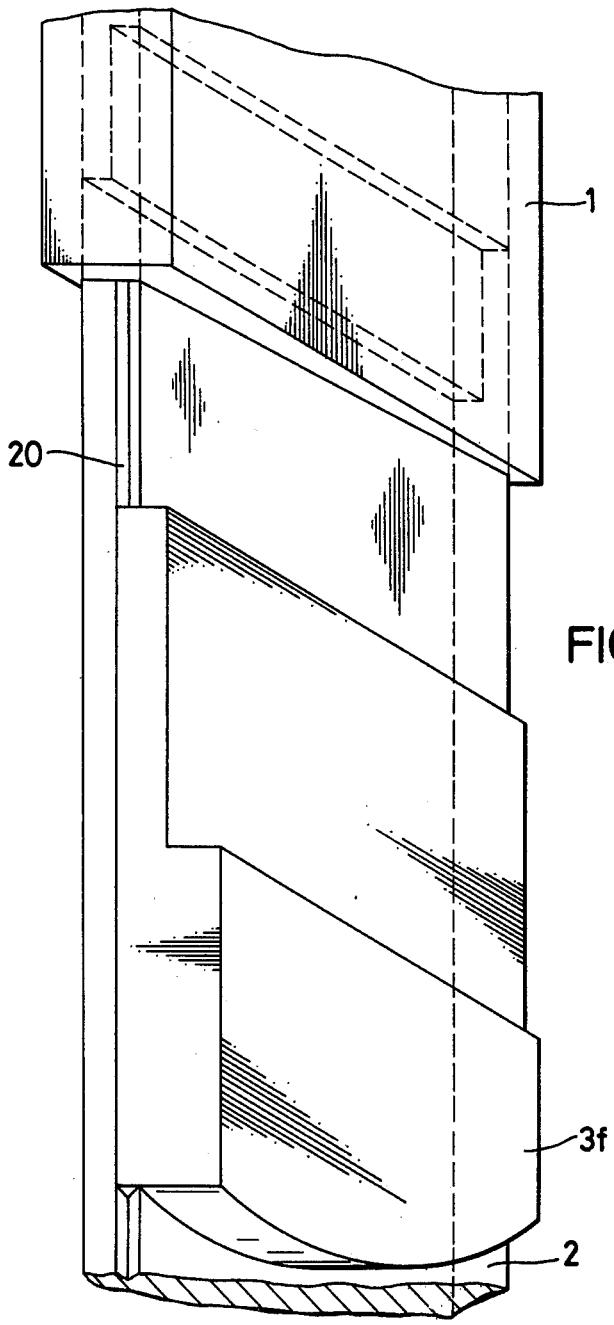
Figure 13:
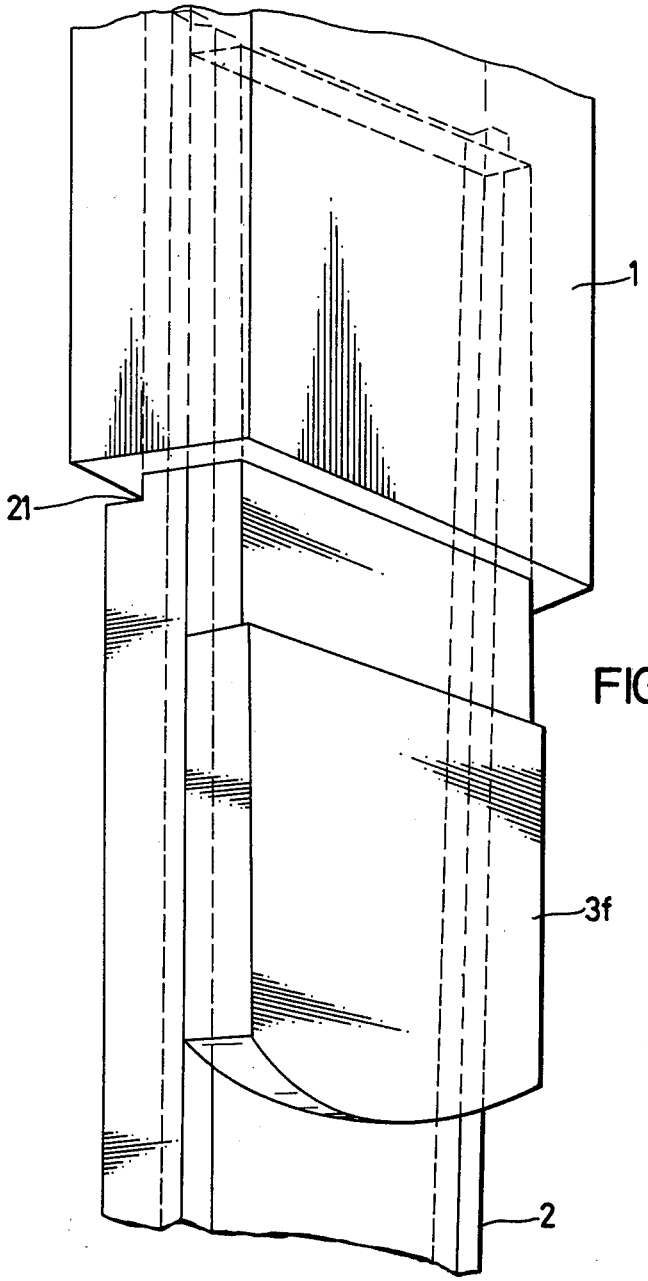

FIGS. 4*a* to 4*c* are diagrammatic side elevations of the ski hinge according to FIG. 1 in various stages of folding;

FIG. 5 is a perspective end elevation of a part of a ski with recesses for the hinge, which is omitted for the sake of clarity;

FIG. 6 shows a section similar to that in FIG. 3, with a modified design of stabilizing device;

FIG. 7 shows a partial section similar to that in FIG. 3, with another modified design of stabilizing device;

FIG. 8 is a part perspective view of a design of separable ski, with the parts thereof separated from each other;

FIG. 9 is a perspective view of a ski according to FIG. 8 in the assembled position and with the stabilizing device in its operative position;

FIG. 10 is a part perspective view of the joint of another design of separable ski having a screwed connection;

FIG. 11 is a part perspective view of the joint of another design of separable ski;

FIG. 12 is a part perspective view of a design of separable ski, in which one part of the ski is adapted to be inserted into the other part of the ski, which is hollow; and FIG. 13 is a part-perspective view of the ski according to FIG. 12, with the stabilizing device in its operative position.

Figure 1A:
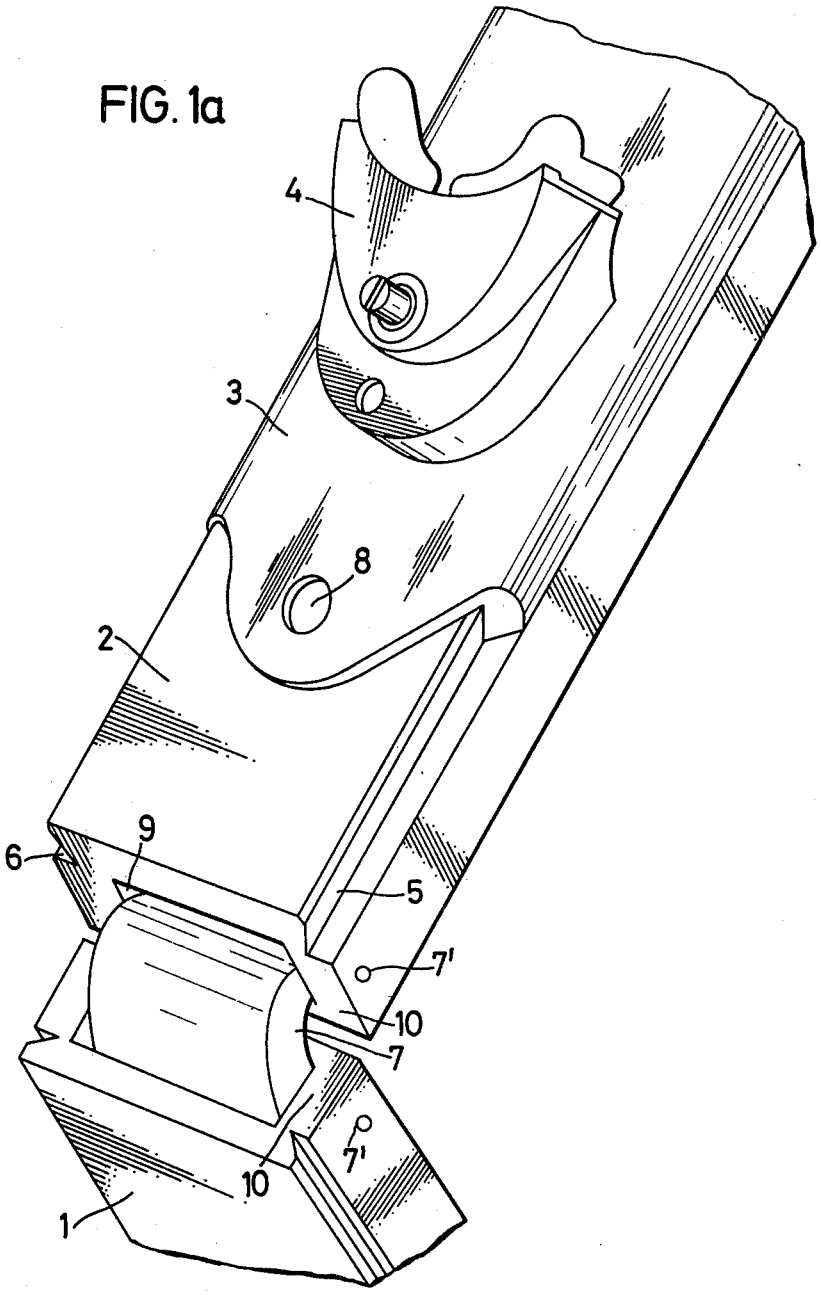

As shown in FIG. 1*a*, the ski according to the present invention has two separable sections, front ski 1 and rear ski 2. Recesses 9 are formed in opposing ends 10 of front ski 1 and rear ski 2. A hinge 7 in the form of a U-shaped hinge element is secured in the recesses by means of pins 7' passing transversely through skis 1 and 2 and through bores 7'' in the hinge (see FIG. 16).

Front ski 1 and rear ski 2 have grooves 5, 6 on each lateral surface; the grooves being in alignment with each other when the parts of the ski are in the extended position. Grooves 5, 6 serve to guide and retain a stabilizing sliding housing 3 upon which is mounted ski binding of which only the front jaw is shown. When ski sections 1, 2 are in the extended position, stabilizing slide housing 3 is pushed along grooves 5, 6 over the joint in end faces 10, and thus unites ski sections 1, 2 rigidly together. Stabilizing slide housing 3 may be locked in its operative position by means of a spring-biased locking pin (not shown) which snaps into a hole 8.

Figure 1B:
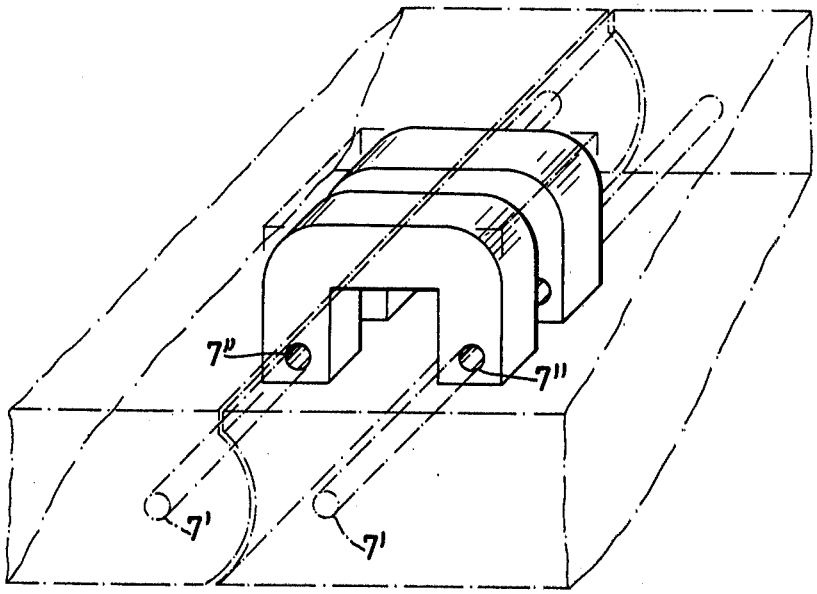

FIG. 1*b* shows a modified design of hinge 7 in the form of two hinge parts divided longitudinally. Furthermore, end-faces 10 of sections 1, 2 of the ski are not flat but are curved cylindrically to match each other.

FIGS. 4*a*–*c* show positions of hinge 7 with ski sections 1, 2 in various stages of folding. If end-faces 10 of the ski sections 1, 2 are to engage with no gap between them, the distance between holes 7'' and the web of the U formed by hinge 7 must be at least equal to the distance "*b*" between pins 7'' and end faces 10, and the distance "*a*" between pins 7'' and the running surface of ski sections 1, 2 must be such that the U-shaped recess in hinge 7 can accommodate the wall parts located between recesses 9 and the running surface when the ski is in the folded position (FIG. 4*c*). If hinge 7 is secured in a manner such that its U-shaped opening points towards the upper surface of ski sections 1, 2, so that the upper surfaces of each ski section lies against each other when the ski is in the folded position, the foregoing comment on distance "*a*" also applies to the upper surface.

FIGS. 3 and 5 to 7 show various designs of stabilizing slide 3 differing from each other by the shape of grooves 5, 6 and the corresponding configuration of the lateral arms which engage with and fill the grooves. FIG. 6 shows a design comprising a dovetail groove 11 on the upper surfaces of ski sections 1, 2 and a corresponding projection 12 on the stabilizing slide, in addition to lateral grooves 5, 6. This provides a particularly strong stabilizing action for ski sections 1, 2 in the extended position, with no play.

FIG. 5 also shows a modified design of recess 9 consisting of two recesses 9' lying side by side instead of a single recess 9. This design is particularly suitable for the double hinge shown in FIG. 1*b*.

In the design according to FIGS. 8 and 9, a hooked connecting plate 13 projects from end-face 10 of front ski 1. Rear ski 2 contains a recess 14 in which a pin 15 is arranged. The dimensions of connecting plate 13, and the position of pin 15 may be such that the said plate can be unhooked from the said pin only when ski sections 1, 2 are parallel with each other, whereas when the two sections are in the extended position, end-faces 10 lie close together and cannot be disconnected. Stabilization slide housing 3 is in the form of a rectangular tube arranged to slide on front ski 1.

In the design according to FIG. 10, the two sections 1, 2 of the ski are connected together by means of a screwed joint 16, 17. The stabilizing slide housing 3 is displaceable in grooves 5, 6.

The design according to FIG. 11 has a plug-in joint resembling a bayonet fastener 18, 19. Projection 18' on pin 18 can be inserted into corresponding recess 19' only when front ski 1 has been rotated through 90° in relation to rear ski 2. After the two sections 1, 2 have been twisted back into the extended position, they are again stabilized by means of stabilizing slide housing 3.

In the design according to FIGS. 12 and 13, front ski 1 is hollow and is designed to accommodate rear ski 2. Stabilizing slide 3*f* is in the form of a stepped tongue and is guided in longitudinal grooves 20 in rear ski 2. Rear ski 2 is stepped at 21 (FIG. 13) so that when ski sections 1, 2 are in the extended and jointed position, its running surface is aligned with the running surface of front ski 1. In this position, the tongue-shaped stabilizing slide may be pushed into the cavity in hollow front ski 1 for stabilization purposes.

As may be gathered from FIG. 4, the wall part between recess 9 and the running surface of the ski part is bevelled in order to facilitate folding. Care must of course be taken, by selecting appropriate dimensions for distances "*a*", "*b*", "*c*" (FIG. 4), to ensure that ski sections 1, 2 may, in fact, be pivoted about the axis 7' of the hinge. If the joint at end-faces 10 of ski parts 1, 2 is located centrally between the hinge axes, the following relationship must apply to distances "*a*", "*b*", "*c*": $2b \geqq a + c$.

While the invention has been particularly shown and described with reference to embodiments by example thereof, it will be understood by those skilled in the art that various changes in form and detail may be made therein without departing from the spirit and scope of the invention.

I claim:

1. A foldable ski which comprises:

a front ski section and a rear ski section having upper, lateral and skiing surfaces, and cylindrically-shaped end faces being complementarily cylindrical to each other with their cylinder axis extending substantially parallel to said skiing surfaces and transversely to the longitudinal direction of the ski, the end faces defining a junction of said front and rear ski sections;

said front and rear ski sections being provided with longitudinally extending guiding means formed in said lateral surfaces thereof, connecting hinge means for connecting said front ski section to said rear ski section at said junction, whereby said guiding means of said front ski section are in alignment with said guiding means of said rear ski section and said cylindrically-shaped end faces contact each other at said junction in an unfolded extended relative position of said ski sections;

recesses in said cylindrically-shaped end faces, and said connecting hinge means including at least one substantially U-shaped hinge part spanning said junction between said front and rear ski sections and arranged in said recesses, said hinge part being attached to said respective ski sections by means of hinge pins passing transversally to said respective ski sections through free ends of legs of said U-shaped hinge part;

a U-shaped stabilizing device having inwardly extending engaging means on each leg of said U-shaped stabilizing device, said stabilizing device being slidably mounted on one of said ski sections in a folded relative position thereof and adapted to cover said junction of said ski sections in said unfolded extended relative position thereof, thereby said engaging means guidably engage said guiding means of said ski sections for effecting the stabilized positioning of said front ski section to said rear ski section; and locking means for fixing the stabilized positioning of said stabilizing device relative to said ski sections.

2. The ski according to claim 1, wherein a ski binding is secured to said U-shaped stabilizing device.

3. The ski according to claim 1 wherein said front and rear ski sections each have a dovetail groove on said upper surfaces thereof, said dovetail grooves being in alignment in said unfolded extended relative position of said ski sections, and said U-shaped stabilizing device having a projection on a lower surface thereof corresponding in cross section to said dovetail grooves and guidably engaging into said grooves.

* * * * *